US005221463A

United States Patent [19]

Kamienski et al.

[11] Patent Number: 5,221,463

[45] Date of Patent: Jun. 22, 1993

[54] FIXED-BED/MOVING-BED TWO STAGE CATALYTIC REFORMING WITH RECYCLE OF HYDROGEN-RICH STREAM TO BOTH STAGES

[75] Inventors: Paul W. Kamienski, Basking Ridge; Gerrit S. Swart, Westfield, both of N.J.

[73] Assignee: Exxon Research & Engineering Company, Florham Park, N.J.

[21] Appl. No.: 805,333

[22] Filed: Dec. 9, 1991

[51] Int. Cl.[5] ..... C10G 35/04

[52] U.S. Cl. ..... 208/65; 208/63; 208/64

[58] Field of Search ..... 208/65, 63

[56] References Cited

U.S. PATENT DOCUMENTS

| | | | |
|---|---|---|---|
| 3,013,088 | 12/1961 | Merryfield | 208/65 |
| 3,384,571 | 5/1968 | Engel | 208/65 |
| 3,432,425 | 3/1969 | Bodkin et al. | 208/65 |
| 3,753,891 | 8/1973 | Graven et al. | 208/65 |
| 3,992,465 | 11/1976 | Juguin et al. | 208/65 |
| 4,002,555 | 1/1977 | Farnham | 208/65 |
| 4,159,937 | 7/1979 | Scott | 208/100 |
| 4,568,451 | 2/1986 | Greenwood | 208/340 |
| 4,925,573 | 5/1990 | Vorlow | 208/100 |
| 4,985,132 | 1/1991 | Moser et al. | 208/65 |
| 5,043,057 | 8/1991 | Boyle | 208/65 |

*Primary Examiner*—Helane Myers
*Attorney, Agent, or Firm*—Henry E. Naylor

[57] ABSTRACT

A two stage process for catalytically reforming a gasoline boiling range hydrocarbonaceous feedstock. The reforming is conducted in two stages wherein the first stage is operated in a fixed bed mode, and the second stage is operated in a moving bed continuous catalyst regeneration mode. A hydrogen-rich stream is recycled through both stages.

6 Claims, 1 Drawing Sheet

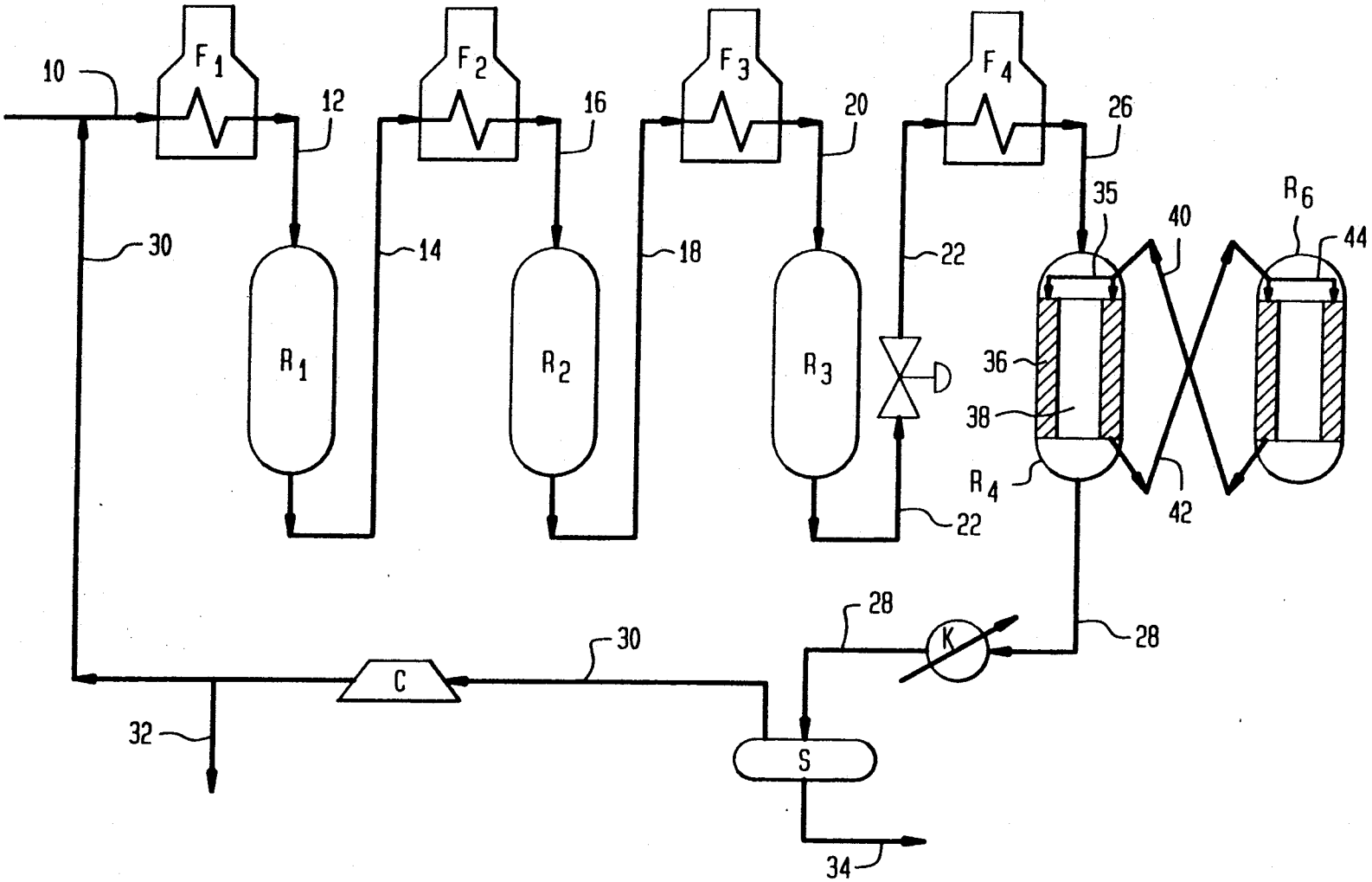
R6
44
40
42
26
35
28
F4
36
38
R4
22
22
K
20
R3
28
S
34
F3
18
30
16
R2
F2
14
C
12
R1
F1
30
32
10

FIXED-BED/MOVING-BED TWO STAGE CATALYTIC REFORMING WITH RECYCLE OF HYDROGEN-RICH STREAM TO BOTH STAGES

FIELD OF THE INVENTION

The present invention relates to a two stage process for catalytically reforming a gasoline boiling range hydrocarbonaceous feedstock. The reforming is conducted in two stages wherein the first stage is operated in a fixed-bed mode, and the second stage is operated in a moving-bed continual catalyst regeneration mode. A hydrogen-rich stream is recycled through both stages.

BACKGROUND OF THE INVENTION

Catalytic reforming is a well established refinery process for improving the octane quality of naphthas or straight run gasolines. Reforming can be defined as the total effect of the molecular changes, or hydrocarbon reactions, produced by dehydrogenation of cyclohexanes, dehydroisomerization of alkylcyclopentanes, and dehydrocyclization of paraffins and olefins to yield aromatics; isomerization of substituted aromatics; and hydrocracking of paraffins which produces gas, and inevitably coke, the latter being deposited on the catalyst. In catalytic reforming, a multifunctional catalyst is usually employed which contains a metal hydrogenation-dehydrogenation (hydrogen transfer) component, or components, usually platinum, substantially atomically dispersed on the surface of a porous, inorganic oxide support, such as alumina. The support, which usually contains a halide, particularly chloride, provide the acid functionality needed for isomerization, cyclization, and hydrocracking reactions.

Reforming reactions are both endothermic and exothermic, the former being predominant, particularly in the early stages of reforming with the latter being predominant in the latter stages. In view thereof, it has become the practice to employ a reforming unit comprised of a plurality of serially connected reactors with provision for heating the reaction stream as it passes from one reactor to another. There are three major types of reforming: semi-regenerative, cyclic, and continuous. Fixed-bed reactors are usually employed in semi-regenerative and cyclic reforming, and moving-bed reactors in continuous reforming. In semi-regenerative reforming, the entire reforming process unit is operated by gradually and progressively increasing the temperature to compensate for deactivation of the catalyst caused by coke deposition, until finally the entire unit is shut-down for regeneration and reactivation of the catalyst. In cyclic reforming, the reactors are individually isolated, or in effect swung out of line, by various piping arrangements. The catalyst is regenerated by removing coke deposits, and then reactivated while the other reactors of the series remain on stream. The "swing reactor" temporarily replaces a reactor which is removed from the series for regeneration and reactivation of the catalyst, which is then put back in the series. In continuous reforming, the reactors are moving-bed reactors, as opposed to fixed-bed reactors, with continuous addition and withdrawal of catalyst. The catalyst descends the reactor in an annular bed and is passed to a regeneration zone where accumulated carbon is burned-off. The catalyst continues to flow through the regenerator and is recycled to the reactor.

With the gradual phasing out of lead from the gasoline pool and with the introduction of premium grade lead-free gasoline in Europe and the United States, petroleum refiners must re-evaluate how certain refinery units are run to meet this changing demand for higher octane fuels without the use of lead. Because catalytic reforming units produce product streams which represent the heart of the gasoline pool, demands are being put on these units for generating streams with ever higher octane ratings.

U.S. Pat. No. 3,992,465 teaches a two stage reforming process wherein the first stage is comprised of at least one fixed-bed reforming zone and the second stage is comprised of a moving-bed reforming zone. The teaching of U.S. Pat. No. 3,992,465 is primarily to subject the reformate, after second stage reforming to a series of fractionations and an extractive distillation of the $C_6$–$C_7$ cut to obtain an aromatic-rich stream.

While such teachings are a step in the right direction, there still remains a need in the art for improved reforming processes which can overcome such disadvantages. There is also a need in the art for the modification of conventional fixed-bed reforming process units to incorporate some of the advantages of moving-bed reforming units, without having to build an entirely new grass-roots moving-bed unit.

SUMMARY OF THE INVENTION

In accordance with the present invention, there is provided a process for catalytically reforming a gasoline boiling range hydrocarbon reactant stream in the presence of hydrogen in a reforming process unit comprised of a plurality of serially connected reforming zones wherein each of the reforming zones contains a reforming catalyst comprised of at least one Group VIII noble metal on a refractory support. The catalyst may be either monofunctional or bifunctional. The process comprises:

(a) reforming the reactant stream in a first reforming stage comprised of one or more serially connected reforming zones containing a fixed-bed of a catalyst comprised of one or more Group VIII noble metals on a refractory support, which one or more reforming zones are operated at reforming conditions which includes a pressure of about 100 to 500 psig, thereby producing a first effluent stream;

(b) passing said first effluent stream to a second reforming stage operated at a pressure which is at least about 50 psig lower than that of the first reforming stage, which second reforming stage is comprised of one or more serially connected reforming zones which are operated in a moving-bed continuous catalyst regeneration mode wherein the catalyst continually descends through each reforming zone, exits, and is passed to a regeneration zone where any accumulated carbon is burned-off, and wherein the regenerated catalyst is recycled back to the one or more moving-bed reforming zones;

(c) passing the effluent stream from said second stage reforming to a separation zone wherein a hydrogen-rich gaseous stream is separated and recycled to the lead reforming zone of said first stage reforming; and (d) collecting the remaining liquid reformate.

In preferred embodiments, the Group VIII noble metal for catalysts in all stages is platinum.

In still other preferred embodiments of the present invention, the catalyst of the final stage is comprised of platinum and tin on a spherical alumina support material.

BRIEF DESCRIPTION OF THE FIGURE

The sole figure hereof depicts a simplified flow diagram of a preferred reforming process of the present invention. The reforming process unit is comprised of a first stage which includes a lead reforming zone, which is represented by a lead fixed-bed reactor, and a first downstream reforming zone, which is represented by another fixed-bed reactor, which first stage is operated in semi-regenerative mode. It will be understood that the fixed-bed reforming zones can also be operated in a cyclic mode. There is also a second stage which contains two serially connected reforming zones in fluid communication with a regenerative zone, which reforming zones are represented by annular radial flow reactors wherein the catalyst continuously descends through the reactors and is transported to the regeneration zone, then back to the reactors, etc. A hydrogen-rich stream is separated from the effluent product stream from the second stage reforming and recycled.

DETAILED DESCRIPTION OF THE INVENTION

Feedstocks, also sometimes referred to herein as reactant streams, which are suitable for reforming in accordance with the instant invention, are any hydrocarbonaceous feedstocks boiling in the gasoline range. Nonlimiting examples of such feedstocks include the light hydrocarbon oils boiling from about 70° F. to about 500° F., preferably from about 180° F. to about 400° F., for example straight run naphthas, synthetically produced naphthas such as coal and oil-shale derived naphthas, thermally or catalytically cracked naphthas, hydrocracked naphthas, or blends or fractions thereof.

Referring to the sole FIGURE hereof, a gasoline boiling range hydrocarbon reactant stream, which is preferably first hydrotreated by any conventional hydrotreating method to remove undesirable components such as sulfur and nitrogen, is passed to a first reforming stage represented by heater, or preheat furnaces $F_1$, $F_2$, and $F_3$, and reactors $R_1$, $R_2$, and $R_3$. A reforming stage, as used herein, is any one or more reforming zones, in this figure reactors, and its associated equipment (e.g., preheat furnaces etc.). The reactant stream is fed into heater, or preheat furnace, $F_1$, via line 10 where it is heated to an effective reforming temperature. That is, to a temperature high enough to initiate and maintain dehydrogenation reactions, but not so high as to cause excessive hydrocracking. Because reforming reactions are typically endothermic, the reactant stream must be reheated to reforming temperatures between reforming zones. The heated reactant stream is then fed, via line 12, into reforming zone $R_1$ which contains a catalyst suitable for reforming. Such a catalyst typically contains at least one Group VIII noble metal with or without a promoter metal, on a refractory support. Reforming zone $R_1$, as well as all the other reforming zones in this first stage, are operated at reforming conditions. Typical reforming operating conditions for the reactors of this first fixed-bed stage include temperatures from about 800° to about 1200° F.; pressures from about 100 psig to about 500 psig, preferably from about 150 psig to about 300 psig; a weight hourly space velocity (WHSV) of about 0.5 to about 20, preferably from about 0.75 to about 5 and a hydrogen to oil ratio of about 1 to 10 moles of hydrogen per mole of $C_5+$ feed, preferably 1.5 to 5 moles of hydrogen per mole of $C_5+$ feed.

The effluent stream from reforming zone $R_1$ is fed to preheat furnace $F_2$ via line 14, then to reforming zone $R_2$ via line 16, then through preheat furnace $F_3$ via line 18, then to reforming zone $R_3$ via line 20. The effluent stream from this first stage which is sent to the second reforming stage via line 22 through pressure control valve 24 where pressure is reduced to the level required for second stage operation. The amount of pressure reduction will depend on the operating pressure of the second stage separation zone S and the pressure drop in furnace $F_4$ and reactor $R_4$, and the connecting piping. The heated reaction stream from furnace $F_4$ is passed to reforming zone $R_4$ via line 26, which reforming zone is operated in a continuous moving bed mode. Reforming conditions for the moving-bed reforming zones will include temperatures from about 800° to 1200° F., preferably from about 800° to 1000° F.; pressures from about 30 to 300, preferably from about 50 to 150 psig; a weight hourly space velocity from about 0.5 to 20,preferably from about 0.75 to 6. Hydrogen-rich gas should be provided to maintain the hydrogen to oil ratio between the range of about 0.5 to 5, preferably from about 0.75 to 3. In the preferred embodiment, all of the hydrogen gas is supplied by the hydrogen-rich predominantly $C_4-$ gaseous stream which passes through pressure control valve 24. Instances may exist in which the gas flowing from the first stage is insufficient to supply the needed hydrogen to oil ratio. This could occur if the feedstock to the first stage was highly paraffinic or had a boiling range which included predominantly hydrocarbons in the 6 to 8 carbon number range. In these instances, hydrogen would need to be supplied from external sources such as a second reforming unit or a hydrogen plant.

Such reforming zones, or reactors, are well known in the art and are typical of those taught in U.S. Pat. Nos. 3,652,231; 3,856,662; 4,167,473; and 3,992,465 which are all incorporated herein by reference. The general principle of operation of such reforming zones is that the catalyst is contained in an annular bed formed by spaced cylindrical screens within the reactor. The reactant stream is processed through the catalyst bed, typically in an out-to-in radial flow, that is, it enters the reactor at the top and flows radially from the reactor wall through the annular bed of catalyst 36 which is descending through the reactor, and passes into the cylindrical space 38, created by said annular bed. The effluent stream from reforming zone $R_4$ is passed via line 28 to cooling zone K where the temperature of the stream is dropped to about 60° to 300° F., preferably from about 80° to 175° F. It is then passed into separation zone S where it is separated into a hydrogen-rich predominantly $C_4-$ gaseous stream, and a predominantly $C_5+$ liquid stream. It is understood that these streams are not pure streams. For example, the separation zone will not provide complete separation between the $C_4-$ components and the $C_5+$ liquids. Thus, the gaseous stream will contain minor amounts of $C_5+$ components and the liquid stream will contain minor amounts of $C_4-$ components and hydrogen. The $C_5+$ stream is collected for blending in the gasoline pool via line 34. The hydrogen-rich $C_4-$ stream is recycled via line 30 through compressor $C_1$ to bring its pressure to the process pressure of first stage reforming. The net product gas portion is sent via line 32 to purification facilities (not shown).

Fresh or regenerated catalyst is charged to reforming zone $R_4$ by way of line 40 and distributed in the annular moving bed 36 by means of catalyst transfer conduits 35, the catalyst being processed downwardly as an annular dense-phase moving bed. The reforming catalyst charged to reforming zone $R_4$ is comprised of at least one Group VIII noble metal, preferably platinum; and optionally one or more promoter metals, preferably tin, on spherical particles of a refractory support, preferably alumina. The spherical particles have an average diameter of about 1 to 3 mm, preferably about 1.5 to 2 mm, the bulk density of this solid being from about 0.5 to 0.9 and more particularly from about 0.5 to 0.8.

The catalyst of reforming zone $R_4$ descends through the zone where it exits and is passed to catalyst regeneration zone RG via line 42 and transfer conduit 44 where the catalyst is subjected to one or more steps common to the practice of reforming catalyst regeneration. The catalyst regeneration zone CR represents all of the steps required to remove at least a portion of the carbon from the catalyst and return it to the state needed for the reforming reactions occurring in reforming zone $R_3$. The specific steps included in CR will vary with the selected catalyst. The only required step is one where accumulated carbon is burned-off at temperatures from about 600° to 1200° F. and in the presence of an oxygen-containing gas, preferably air. Additional steps which may also be contained in the catalyst regeneration equipment represented by CR include, but are not limited to, adding a halide to the catalyst, purging carbon oxides, redispersing metals, and adding sulfur or other compounds to lower the rate of cracking when the catalyst first enters the reforming zone. The regenerated catalyst is then charged to reforming zone $R_4$ via line 40 and the cycle of continuous catalyst regeneration is continued until the entire reforming unit (both stages) is shut down, such as for catalyst regeneration of first stage reforming, for example when the first stage reforming zones are fixed-bed and are operated in a semi-regenerative mode. It is to be understood that the catalyst in the moving-bed reforming and regeneration zones may not be constantly moving, but may only move intermittently through the system. This may be caused by the opening an closing of various valves in the system. Thus, the word "continuous" is not to be taken literally and the word "continual" is sometimes used interchangeably with "continuous".

The moving-bed zones of the second stage may be arranged in series, side-by-side, each of them containing a reforming catalyst bed slowly flowing downwardly, as mentioned above, either continuously or, more generally, periodically, said bed forming an uninterrupted column of catalyst particles. The moving bed zones may also be vertically stacked in a single reactor, one above the other, so as to ensure the downward flow of catalyst by gravity from the upper zone to the next below. The reactor then consists of reaction zones of relatively large sections through which the reactant stream, which is in a gaseous state, flows from the periphery of the interior of the reactor (although a reactor can be designed to have the reactant stream flow from the center to the periphery) interconnected by catalyst zones of relatively small sections, the reactant stream issuing from one catalyst zone of large section divided into a first portion (preferably from 1 to 10%) passing through a reaction zone of small section for feeding the subsequent reaction zone of large section and a second portion (preferably from 99 to 90%) sent to a thermal exchange zone and admixed again to the first portion of the reactant stream at the inlet of the subsequent catalyst zone of large section.

When using one or more reaction zones with a moving-bed of catalyst, said zones as well as the regeneration zone, are generally at different levels. It is therefore necessary to ensure several times the transportation of the catalyst from one relatively low point to a relatively high point, for example from the bottom of a reaction zone to the top of the regeneration zone, said transportation being achieved by any lifting device simply called "lift" (not shown in the FIGURE hereof). The fluid of the lift used for conveying the catalyst may be any convenient gas, for example nitrogen or still for example hydrogen and more particularly purified hydrogen or recycle hydrogen.

Catalysts suitable for use in any of the reactors of any of the stages include both monofunctional and bifunctional, monometallic and multimetallic noble metal-containing reforming catalysts. Preferred are the bifunctional reforming catalysts comprised of a hydrogenation-dehydrogenation function and an acid function. The acid function, which is important for isomerization reactions, is thought to be associated with a material of the porous, adsorptive, refractory oxide type which serves as the support, or carrier, for the metal component, usually a Group VIII noble metal, preferably Pt, to which is generally attributed the hydrogenation-dehydrogenation function. The preferred support for both stages of reforming is an alumina material, more preferably gamma alumina. It is understood that the support material for the second stage reforming must be in the form of substantially spherical particles as previously described. One or more promoter metals selected from metals of Groups IIIA, IVA, IB, VIB, and VIIB of the Periodic Table of the Elements may also be present. The promoter metal, can be present in the form of an oxide, sulfide, or in the elemental state in an amount from about 0.01 to about 5 wt. %, preferably from about 0.1 to about 3 wt. %, and more preferably from about 0.2 to about 3 wt. %, calculated on an elemental basis, and based on total weight of the catalyst composition. It is also preferred that the catalyst compositions have a relatively high surface area, for example, about 100 to 250 $m^2/g$. The Periodic Table of which all the Groups herein refer to can be found on the last page of Advanced Inorganic Chemistry, 2nd Edition, 1966, Interscience publishers, by Cotton and Wilkinson.

The halide component which contributes to the necessary acid functionality of the catalyst may be fluoride, chloride, iodide bromide, or mixtures thereof. Of these, fluoride, and particularly chloride, are preferred. Generally, the amount of halide is such that the final catalyst composition will contain from about 0.1 to about 3.5 wt. %, preferably from about 0.5 to about 1.5 wt. % of halogen calculated on an elemental basis.

Preferably, the platinum group metal will be present on the catalyst in an amount from about 0.01 to about 5 wt. %, calculated on an elemental basis, of the final catalytic composition. More preferably, the catalyst comprises from about 0.1 to about 2 wt. % platinum group component, especially about 0.1 to 2 wt. % platinum. Other preferred platinum group metals include palladium, iridium, rhodium, osmium, ruthenium and mixtures thereof.

By practice of the present invention, the reduction of pressure between stages allows one to capture maximum yield credits from the low pressure second stage.

The first stage reactors are operated at conventional reforming temperatures and pressures in semiregenerative or cyclic mode while the reactors of the second stage are moving bed reactors operated substantially at lower pressures. Such pressures in the second stage may be from as low as about 30 psig to about 100 psig.

Various changes and/or modifications, such as will present themselves to those familiar with the art may be made in the method and apparatus described herein without departing from the spirit of this invention whose scope is commensurate with the following claims.

What is claimed is:

1. A process for catalytically reforming a gasoline boiling range hydrocarbon reactant stream in the presence of hydrogen in a reforming process unit comprised of a plurality of serially connected reforming zones wherein each of the reforming zones contains a reforming catalyst comprised of one or more Group VIII noble metals on a refractory support, the process comprising:

(a) reforming the reactant stream in a first reforming stage comprised of one or more serially connected reforming zones containing a fixed-bed of catalyst particles comprised of one or more Group VIII noble metals on a refractory support, which one or more reforming zones are operated at reforming conditions which includes a pressure of about 100 to 500 psig, thereby producing a first effluent stream;

(b) passing said first effluent stream to a second reforming stage operated at a pressure which is at least about 50 psig lower than that of the first reforming stage, which second reforming stage is comprised of one or more serially connected reforming zones which are operated in a moving-bed continuous catalyst regeneration mode, wherein the catalyst continually descends through one or more reforming zones, exits, and is passed to a regeneration zone where at least a portion of any accumulated carbon is burned-off, and wherein the regenerated catalyst is recycled back to the one or more reforming zones;

(c) passing the effluent stream from said second stage reforming to a separation zone wherein at least a portion of a hydrogen-rich gaseous stream is separated and recycled to the lead reforming zone of said first stage reforming; and (d) collecting the remaining liquid reformate.

2. The process of claim 1 wherein the catalyst of the second reforming stage is comprised of about 0.01 to 5 wt. % platinum, 0.01 to 5 wt. % tin, on substantially spherical particles of a refractory support.

3. The process of claim 2 wherein the amount of platinum and tin are each from about 0.1 to 2 wt. % and the spherical refractory support particles are comprised of alumina.

4. The process of claim 1 wherein the catalyst in each of the first stage reforming zones is comprised of about 0.01 to 5 wt. % platinum, and about 0.01 to 5 wt. % of at least one metal selected from the group consisting of iridium, rhenium, and tin.

5. The process of claim 3 wherein the catalyst in each of the first stage reforming zones is comprised of about 0.01 to 5 wt. % platinum, and about 0.01 to 5 wt. % of at least one metal selected from the group consisting of iridium, rhenium, and tin.

6. The process of claim 5 wherein: (i) the catalyst in each of the reforming zones of the first reforming zones is comprised of about 0.01 to 5 wt. % platinum, and about 0.01 to 5 wt. % of at least one metal selected from the group consisting of iridium, rhenium, and tin; and (ii) the catalyst in each of the reforming zones of the second reforming stage is comprised of about 0.1 to 2 wt. % platinum, and about 0.1 to 2 wt. % tin on substantially spherical refractory support.

* * * * *